United States Patent [19]

Nakayama

[11] Patent Number: 4,683,777

[45] Date of Patent: Aug. 4, 1987

[54] INHIBITOR MEANS FOR A STARTER DEVICE IN A MULTI-TRANSMISSION MOTOR VEHICLE

[75] Inventor: Hitoshi Nakayama, Saitama, Japan

[73] Assignee: Honda Giken Kogyo Kabushiki Kaisha, Tokyo, Japan

[21] Appl. No.: 639,167

[22] Filed: Aug. 8, 1984

[30] Foreign Application Priority Data

Aug. 8, 1983 [JP] Japan ..... 58-143634

[51] Int. Cl.[4] ..... F02N 11/08; F02N 11/10

[52] U.S. Cl. ..... 74/850; 123/198 D

[58] Field of Search ..... 74/850; 123/198 D; 70/220, 262, 263, 264; 200/61.91

[56] References Cited

U.S. PATENT DOCUMENTS

| | | | |
|---|---|---|---|
| 3,613,482 | 10/1971 | Benson, Jr. et al. | 74/850 |
| 3,718,128 | 2/1973 | Botker | 123/198 D X |
| 3,811,020 | 5/1974 | Johnson et al. | 74/850 X |
| 4,172,394 | 10/1979 | Kudo et al. | 74/850 |
| 4,275,612 | 6/1981 | Silvester | 74/850 X |
| 4,498,359 | 2/1985 | Hara | 74/850 |
| 4,539,447 | 9/1985 | Mizutani et al. | 200/61.91 |
| 4,541,307 | 9/1985 | Bellah | 74/850 |

FOREIGN PATENT DOCUMENTS

| | | |
|---|---|---|
| 59-69551 | 4/1984 | Japan . |
| 59-69552 | 4/1984 | Japan . |

*Primary Examiner*—Leslie Braun
*Assistant Examiner*—Dirk Wright
*Attorney, Agent, or Firm*—Armstrong, Nikaido, Marmelstein & Kubovcik

[57] ABSTRACT

An engine starter device for a motor cycle including an engine, a primary transmission having a neutral gear position, and a secondary transmission having a reverse gear position. The engine starter device starts the engine only when the primary transmission is in the neutral gear position and the secondary transmission is not in the reverse gear position.

2 Claims, 5 Drawing Figures

INHIBITOR MEANS FOR A STARTER DEVICE IN A MULTI-TRANSMISSION MOTOR VEHICLE

BACKGROUND OF THE INVENTION

1. Field of the Invention

The present invention relates to a starter device for motor vehicle engines, and more particularly to an engine starter device for three-wheeled or four-wheeled off-road motorcycles or motor vehicles with bar handles including a primary transmission having a neutral gear position and a secondary transmission having forward and reverse gear positions.

2. Description of the Prior Art

The applicant has proposed, in Japanese Patent Application No. 57-179779 (published on Apr. 19, 1984 as Japanese Laid-Open Patent Publication No. 59-69552), a motor vehicle transmission system for transmitting an engine power output to driven wheels through a primary transmission having a neutral gear position and a secondary transmission having forward and reverse gear positions.

In a motor vehicle with such a transmission system, it is preferable that the engine be started while the neutral gear position is selected in the primary transmission and the forward gear position is selected in the secondary transmission.

SUMMARY OF THE INVENTION

The present invention has been made to meet the above requirement in motor vehicles having the transmission system of the type described above.

According to the present invention, there is provided an engine starter device in a motor vehicle including an engine, a primary transmission having at least one forward gear position and a neutral gear position, a secondary transmission operatively coupled with the primary transmission and having at least one forward gear position and at least one reverse gear position, and at least one driven wheel operatively coupled with the secondary transmission, the engine starter device comprising a power supply, a starter motor connected to the power supply for starting the engine, and a switching means connected between the power supply and the starter motor for electrically connecting the power supply to the starter motor to start the engine when the primary transmission is in the neutral gear position and the secondary transmission is in a gear position other than the reverse gear position.

Accordingly, it is an object of the present invention to provide a starter device capable of starting a motor vehicle engine satisfactorily.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
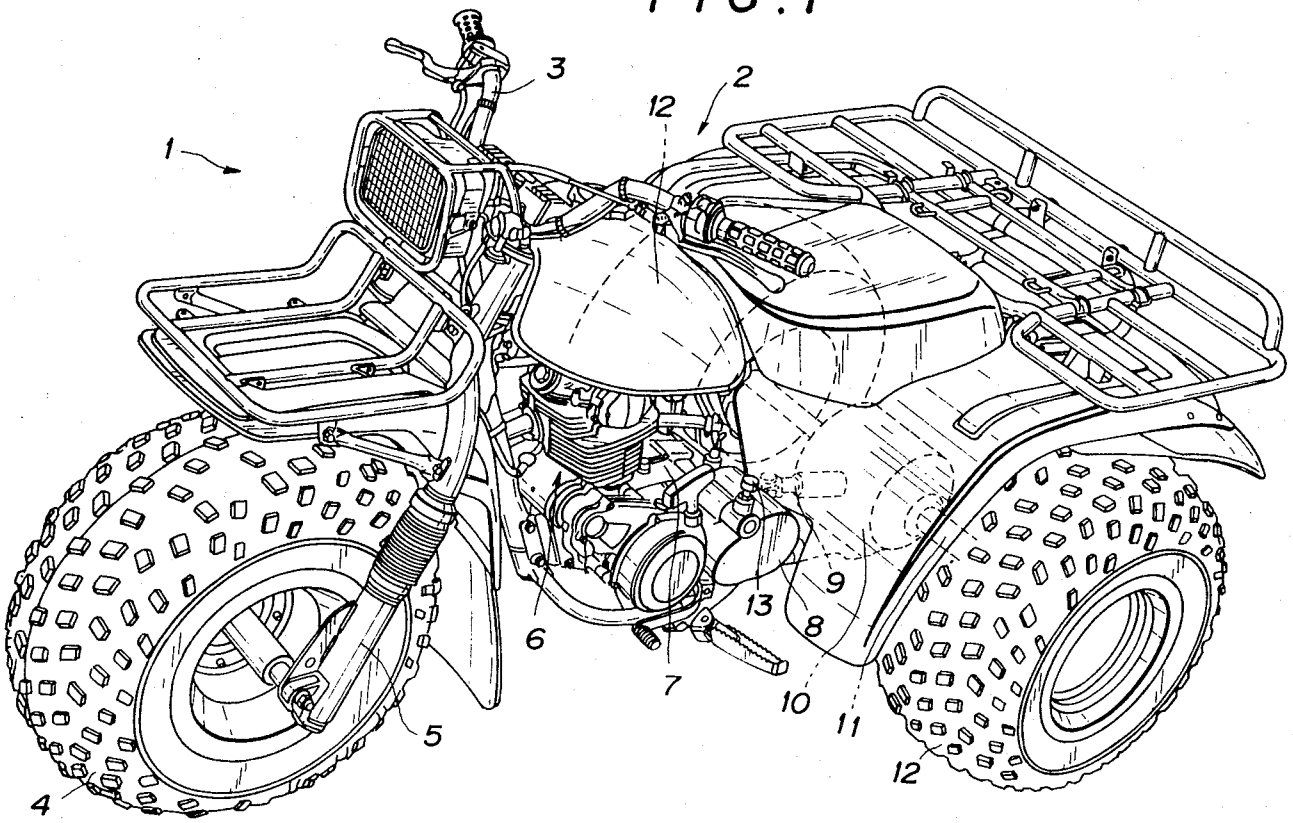
FIG. 1 is a perspective view of an off-road three-wheeled motor vehicle having an engine starter device according to a preferred embodiment of the present invention.

Referring to FIG. 1, an off-road three-wheeled motorcycle or motor vehicle 1 incorporates therein an engine starter device according to the present invention. The motorcycle 1 includes a body 2 having on a front end thereof a steerable bar handle 3 for steering a front wheel 4 through a front fork 5.

An engine 6 is mounted centrally on the body 2 and produces an power output that is to be transmitted through a primary transmission 7 disposed behind the engine 6, a secondary transmission 8 disposed laterally of and behind the primary transmission 7, a propeller shaft 9 rotatably drivable by the secondary transmission 8, a differential 10 to which rotative power from the propeller shaft 9 is transmitted, and a rear axle 11 drivable by the differential 10, to rear driven wheels 12, 12 supported on opposite ends of the rear axle 11. The primary transmission 7 is shiftable selectively into six gear positions, that is, five forward speeds or gear positions and a neutral gear position, by a shift pedal (not shown). The secondary transmission 8 is shiftable selectively into three gear positions, that is, two forward gear positions or speeds, high and low, and a reverse gear position, by actuating a control lever 13 mounted on an upper surface of the secondary transmission 8.

The overall construction of the three-wheeled motorcycle including the primary and second transmissions is basically the same as that of the three-wheeled motorcycle disclosed in the earlier application referred to above, and hence will not be described in detail. For a better understanding, however, the transmissions, particularly the secondary transmission, will hereinafter be described in detail.

Figure 2:
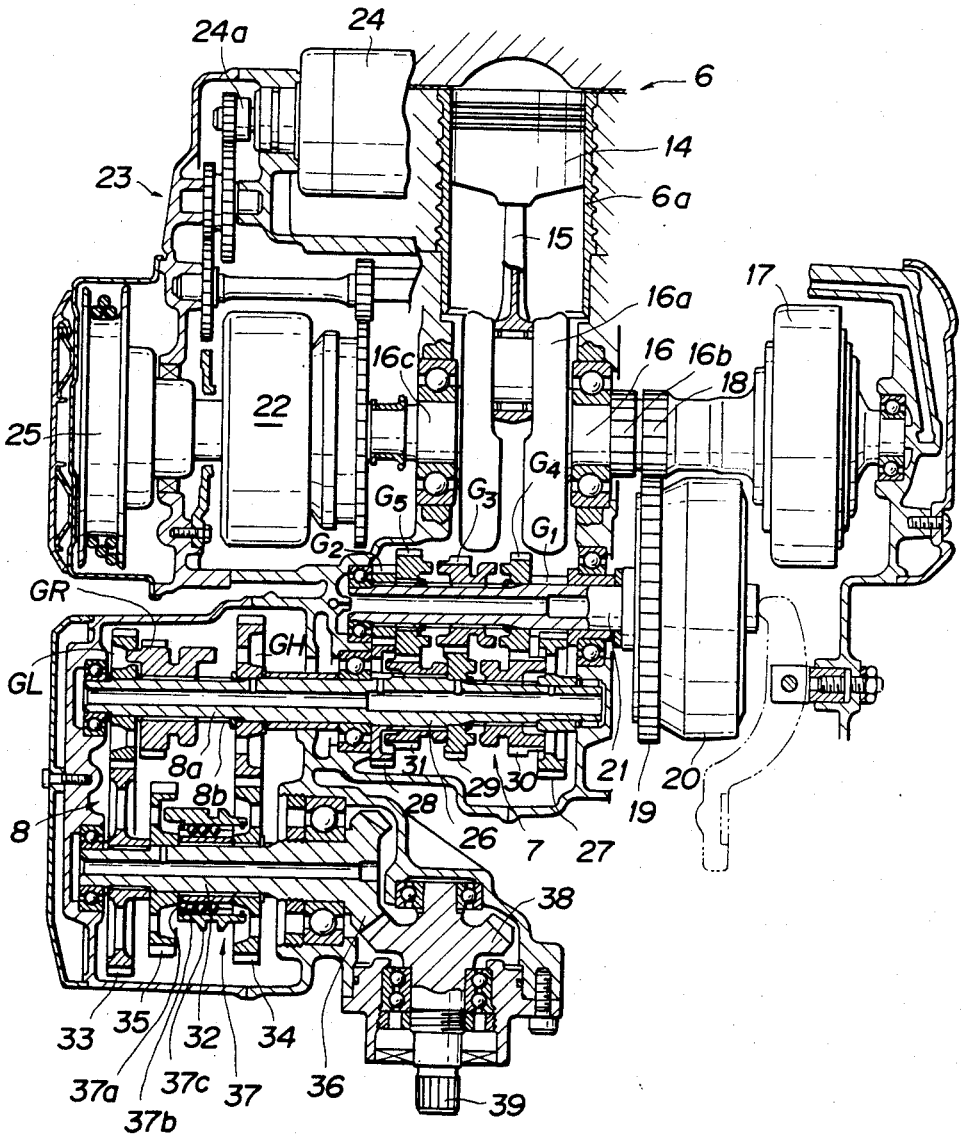
FIG. 2 is a cross-sectional view of a drive train from an engine to a drive shaft in the three-wheeled motor vehicle shown in FIG. 1.

FIG. 2 illustrates a drive train from the engine 6 to an output end of the secondary transmission 8 for connection to the propeller shaft. The lower end of the drive train as shown in FIG. 2 is directed rearward of the motorcycle.

The engine 6 comprises a cylinder 6*a*, a piston 14 slidably fitted in the cylinder 6*a*, and a connecting rod 15 supporting the piston 14 and rotatably coupled to a crank 16*a* of a crank shaft 16 extending transversely of the motorcycle.

Rotative power of the crank shaft 16 is transmitted from an end 16*b* thereof through an automatic centrifugal clutch 17 having an output gear 18 and a manually operated clutch 20 having an input gear 19 meshing with the output gear 18 of the automatic centrifugal clutch 17 to an input shaft 21 of the primary transmission 7 which extends transversely of the motorcycle.

The crank shaft 16 has an opposite end 16*c* connected to a generator 22 and a recoil starter 25 and also to an output shaft 24*a* of a starter through a train of gears 23. The recoil starter 25 is used when manually starting the engine 6.

The primary transmission 7 is composed of five gears $G_1$ through $G_5$ formed or mounted on the input shaft 21 and corresponding respectively to the five forward speeds, an output shaft 26 extending parallel to the input shaft 21, and other five gears 27 through 31 mounted on the input shaft 21 for respectively meshing with the gears $G_1$ through $G_5$. The five forward speeds can be selected by the non-illustrated shift pedal, a shift drum interlinked with the shift pedal, and a shift fork engaging the shift drum. The construction and operation of such a shift mechanism is known in the field of two-wheeled and three-wheeled motorcycles, and will not be described in detail. The automatic centrifugal clutch 17, the manually operated clutch 20, and the starter 24 associated with the engine 6 are also known in the art and will not be described in detail.

The secondary transmission 8 includes an input shaft 8*a* which is an axial extension of the output shaft 26 of the primary transmission 7, low- and high-speed gears GL, GH rotatably fitted over the input shaft 8*a*, and a reverse drive gear GR axially movably fitted over splines 8*b* defined on an outer peripheral surface of the input shaft 8*a* between the gears GL, GH. The reverse drive gear GR doubles as a dog clutch.

The secondary transmission 8 also includes an output shaft 32 disposed behind and parallel to the input shaft 8*a* and having an output bevel gear 36 on an inner end thereof, low- and high-speed driven gears 33, 34 axially immovably splined to the output shaft 32 and held in mesh with the gears GL, GH at all times, a reverse driven gear 35 rotatably fitted over the output shaft 32 between the driven gears 33, 24, and a reverse slider 37 splined to the output shaft 26 between the gears 35, 34. The reverse slider 37 is composed of an inner tubular member 37*a* splined to the output shaft 32 and an outer member 37*c* mounted by a ball bearing clutch 37*b* on an outer peripheral surface of the inner tubular member 37*a* and serving as a dog clutch axially movable only toward the reverse driven gear 35.

The gear GR and the outer member 37*c* of the reverse slider 37 are axially moved by shift forks (described later).

FIG. 2 shows the position of the parts in which the secondary transmission 8 is in the forward low-speed gear position. Drive power from the input shaft 8*a* is transmitted through the reverse drive gear GR, the low-speed gear GL and the low-speed driven gear 33 to the output shaft 32.

When the reverse drive gear GR is moved to the right (FIG. 2) to place the secondary transmission 8 in the forward high-speed gear position, drive power from the input shaft 8*a* is transmitted through the reverse drive gear GR, the high-speed gear GH and the high-speed driven gear 34 to the output shaft 32.

When the reverse drive gear GR is moved slightly to the right out of mesh with the dog clutch of the gear GL and the outer member 37*c* of the reverse slider 37 is moved to the left into engagement with the reverse driven gear 35, the secondary transmission 8 is put in the reverse gear position. It is to be noted here that the gears GR, 35 are kept in mesh with a reverse idler gear (not shown in FIG. 2) at all times. The outer member 37*c* is now fixedly coupled to the inner tubular member 37*a* through the ball bearing clutch 37*b*. In the reverse gear position, drive power from the input shaft 8*a* is transmitted through the reverse drive gear GR, the non-illustrated reverse idler gear, the reverse driven gear 35, and the reverse slider 47 to the output shaft 32 which is then rotated in a direction opposite to that in which the output shaft 32 is rotated in the forward low- and high-speed gear positions as described above.

In any of the foregoing gear positions, the drive power transmitted to the output shaft 32 is transmitted to a final output shaft 39 oriented in the longitudinal direction of the motorcycle and having on a front end thereof a bevel gear 38 held in mesh with the bevel gear 36 of the output shaft 32 at all times.

The final output shaft 39 is coupled to the propeller shaft 9 shown in FIG. 1.

Figure 3:
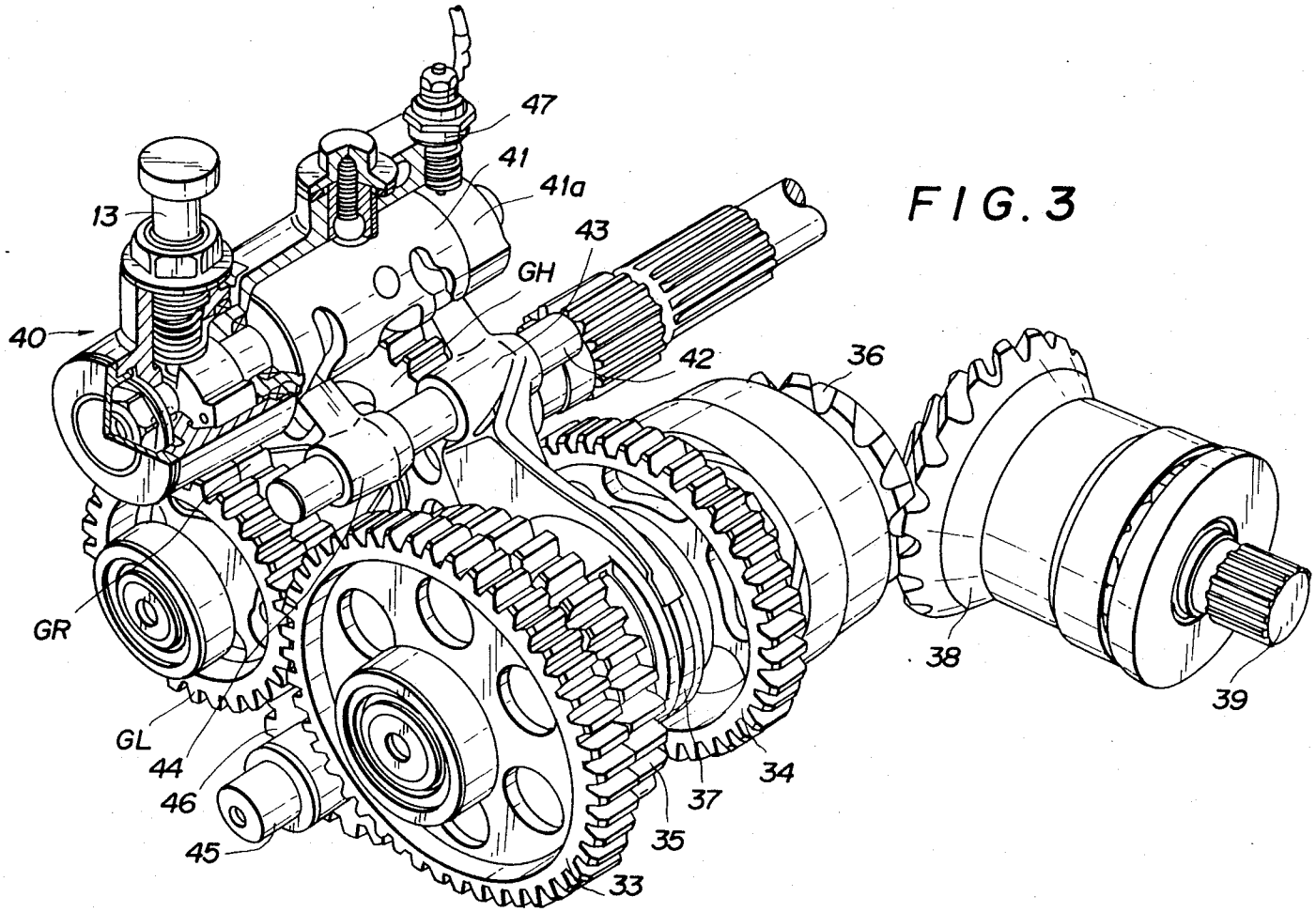
FIG. 3 is a perspective view, partly broken away, of a secondary transmission in the drive train illustrated in FIG. 2.

FIG. 3 is illustrative of a shifting mechanism 40 for the secondary transmission 8 of FIG. 2. The shifting mechanism 40 has a shift drum 41 actuatable by the control lever 13, a support shaft 42 fixed to a transmission case (not shown) and extending transversely of the motorcycle, and a pair of shift forks 43, 44 mounted on the support shaft 42 and actuatable by the shift drum 41.

The secondary transmission 8 further includes a reverse idler shaft 45 disposed below and substantially intermediate the input shaft 8*a* and the output shaft 32, and a reverse idler gear 46 mounted on the reverse idler shaft 45 and held in mesh with the reverse driven gear 35 at all times.

Figure 4:
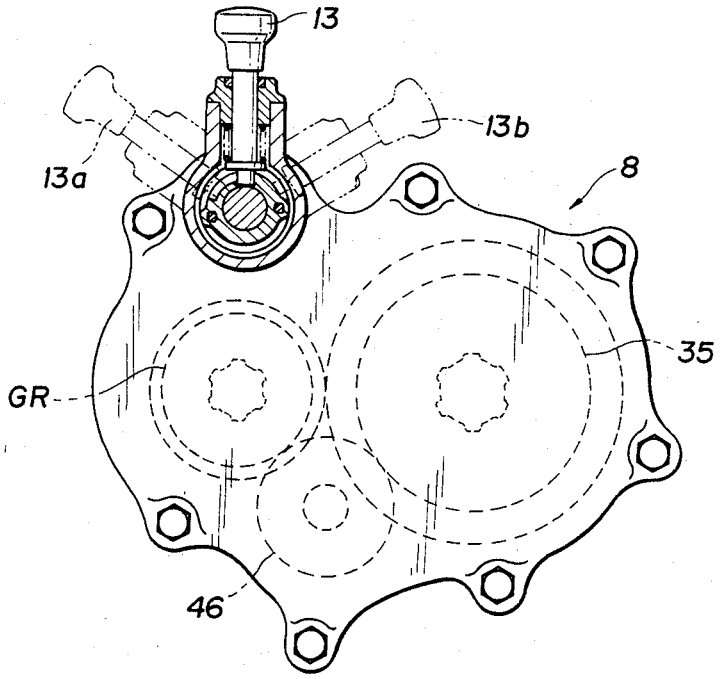
FIG. 4 is a side elevational view of the secondary transmission of FIG. 3.

FIG. 4 shows the relative positional relationship between the reverse drive gear GR, the reverse idler gear 46, and the reverse driven gear 35 as seen in side elevation. The secondary transmission 8 is arranged such that it is put in the forward low-speed gear position when the control lever 13 is an intermediate or erect position. When the control lever 13 is tilted to a forward position 13*a*, the secondary transmission 8 is placed in the forward high-speed gear position, and when the control lever 13 is tilted to a rearward position 13*b*, the secondary transmission 8 is placed in the reverse gear position.

Turning back to FIG. 3, the shift drum 41 has on one end thereof a cam 41*a*. A second detector 47 is positioned to coact with the cam 41*a* for detecting the reverse gear position only of the secondary transmission 8.

A shift drum (not shown) for the primary transmission 7 is also associated with a first detector (not shown in FIGS. 2 through 4) for detecting the neutral position of the primary transmission 7.

Figure 5:
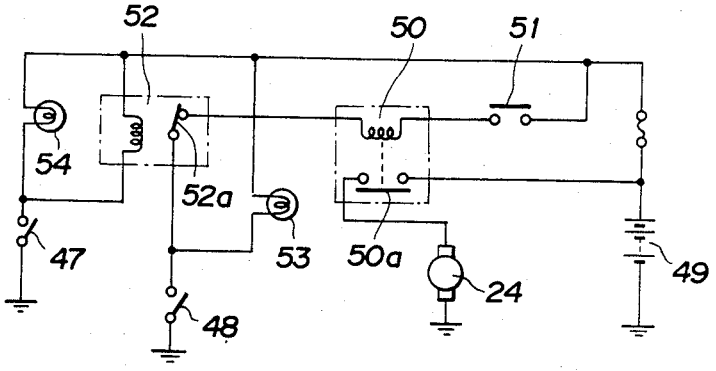
FIG. 5 is a circuit diagram of the engine starter device according to the present invention.

FIG. 5 illustrates an electric circuit for the engine starter device according to the present invention.

An inhibitor or second relay 52 is connected between a power supply 49 and the second detector 47 which is turned on when the secondary transmission 8 is put in the reverse gear position. The inhibitor relay 52 is energized or opened when the second detector 47 is turned on.

The first detector which is turned on when the primary transmission 7 is shifted to the neutral position is designated at 48 is FIG. 5 and connected through a contact 52*a* of the relay 52, a first relay 50, and a starter switch 51 to the power supply 49. The first relay 50 is energized or closed only when the first detector 48 is turned on and the starter switch 51 is closed at the time the second relay 52 remains de-energized.

The starter 24 is connected through a contact 50*a* of the first relay 50 to the power supply 49.

Therefore, the starter 24 can be actuated to start the engine 6 only when the primary transmission 7 is in the neutral gear position and the secondary transmission 8 is in a gear position other than the reverse gear position. At the time the first and second detectors 48, 47 are turned on, indicator lamps 53, 54 are turned on respectively thereby.

With the arrangement of the present invention, the starter motor is put into operation only when the primary transmission is in the neutral gear position and the secondary transmission is in a gear position other than the reverse gear position. The engine can be started by energizing the starter motor when the gear positions are selected as above for the primary and secondary transmissions, and after the engine has been started, the primary transmission is operated to get the motorcycle started smoothly.

The first detector 48, the first relay 50, the starter switch 51, and the contact 52*a* of the inhibitor relay 52 may be connected in any desired sequence provided they are series-connected. The first and second detectors 47, 48 may comprise switches connected in the control circuit for the starter motor. The circuit arrangement of FIG. 5 can be constructed very inexpensively.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative, and not restrictive. The scope of the invention is indicated by the appended claims rather than by the foregoing description.

What is claimed is:

1. An engine starter device in a motor vehicle including an engine, a primary transmission having at least one forward gear position and a neutral gear position, a secondary transmission operatively coupled with the primary transmission and having at least one forward gear position and at least one reverse gear position, and at least one driven wheel operatively coupled with the secondary transmission, said engine starter device comprising:

a power supply;

a starter motor connected to said power supply for starting the engine; and switching means connected between said power supply and said starter motor for electrically connecting the power supply to the starter motor to start the engine when the primary transmission is in the neutral gear position and the secondary transmission is in a gear position other than the reverse gear position, said switching means comprising:

(a) first relay means connected between said power supply and said starter motor;

(b) a starter switch;

(c) a first detector for detecting the neutral gear position of said primary transmission, said first detector being energizable when said primary transmission is put in the neutral position;

(d) a second detector for detecting the reverse gear position of said secondary transmission, said second detector being energizable when said secondary transmission is put in the neutral position;

(e) an inhibitor relay connected to said second detector and actuatable when said second detector is turned on; and (f) said starter switch, said first detector, and said inhibitor relay being series-connected as a circuit for energizing said first relay means.

2. An engine starter device according to claim 1, wherein said motor vehicle comprises an off-road three-wheeled motorcycle having a front wheel and a pair of rear driven wheels.

* * * * *